US008038504B1

(12) United States Patent
Wong

(10) Patent No.: US 8,038,504 B1
(45) Date of Patent: Oct. 18, 2011

(54) TOY VEHICLE

(75) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 0 days.

(21) Appl. No.: 12/965,696

(22) Filed: Dec. 10, 2010

(51) Int. Cl.
*A63H 30/00* (2006.01)
*A63H 17/00* (2006.01)

(52) U.S. Cl. ..... 446/454; 446/431

(58) Field of Classification Search ..... 446/431, 446/441, 443, 454–457, 460, 465, 466, 468, 446/470, 484
See application file for complete search history.

(56) References Cited

U.S. PATENT DOCUMENTS

| | | | | |
|---|---|---|---|---|
| 1,868,313 | A | 7/1932 | Daubendiek | |
| 1,871,297 | A | 8/1932 | Berger | |
| 2,064,309 | A | 12/1936 | Lohr | |
| 2,247,354 | A | 7/1941 | Berger | |
| 2,794,295 | A | 6/1957 | Robertson | |
| 3,445,959 | A * | 5/1969 | Disko Harry et al. | 446/442 |
| 4,209,942 | A | 7/1980 | Lohr | |
| 4,300,308 | A * | 11/1981 | Ikeda | 446/457 |
| 4,490,124 | A | 12/1984 | Ogawa | |
| 4,655,724 | A | 4/1987 | Law | |
| 4,969,851 | A * | 11/1990 | Rasmussen | 446/444 |
| 5,667,420 | A * | 9/1997 | Menow et al. | 446/433 |
| 5,727,985 | A | 3/1998 | George et al. | |
| 5,868,600 | A | 2/1999 | Watanabe | |
| 5,919,075 | A | 7/1999 | George et al. | |
| 5,921,843 | A | 7/1999 | Skrivan et al. | |
| 6,095,890 | A * | 8/2000 | George et al. | 446/437 |
| 6,234,866 | B1 * | 5/2001 | Ben-Yakar et al. | 446/431 |
| 6,439,948 | B1 * | 8/2002 | Ostendorff et al. | 446/154 |
| 6,458,008 | B1 | 10/2002 | Hyneman | |
| 6,589,098 | B2 * | 7/2003 | Lee et al. | 446/465 |
| 6,692,333 | B2 | 2/2004 | Kislevitz et al. | |
| 6,705,917 | B2 | 3/2004 | Filo | |

(Continued)

FOREIGN PATENT DOCUMENTS

GB 2214099 A * 8/1989

OTHER PUBLICATIONS

"Auto Orientation Sensor in the Future?" *HeliFreak*, http://www.helifreak.com/showthread.php?t=247239 (Date Accessed, Nov. 14, 2010).

(Continued)

*Primary Examiner* — Gene Kim
*Assistant Examiner* — Alyssa Hylinski
(74) *Attorney, Agent, or Firm* — Greenberg Traurig, LLP

(57) ABSTRACT

A toy includes a vehicle body having a front portion and a rear portion. A pair of rear wheels is coupled with the rear portion and located on the vehicle so as to at least partially support the rear portion. A first electric motor is drivingly coupled with the at least one rear wheel. There is a pair of front wheels coupled with the front portion and located on the vehicle so as to at least partially support the front portion. An electrically operated steering actuator is mounted on the front portion and is drivingly coupled to the at least one front wheel to rotate the front wheels to steer the toy vehicle. When the vehicle is inverted, the sensor detects the orientation change and signals a microprocessor inside the vehicle, the microprocessor responds to the signal and changes the left/right motor control signal to the steering motor and the forward/backward motor control signal on the driving motor.

9 Claims, 13 Drawing Sheets

U.S. PATENT DOCUMENTS

| | | | | |
|---|---|---|---|---|
| 6,746,304 | B1 | 6/2004 | Liu | |
| 6,764,374 | B2 | 7/2004 | Tilbor et al. | |
| 6,837,327 | B2 | 1/2005 | Heinzmann | |
| 6,939,197 | B1 | 9/2005 | Hoeting | |
| 7,056,185 | B1 | 6/2006 | Anagnostou | |
| 2001/0044255 | A1 | 11/2001 | Lee et al. | |
| 2004/0002283 | A1* | 1/2004 | Herbert et al. | 446/269 |
| 2008/0113800 | A1 | 5/2008 | Ciavaglia et al. | |
| 2009/0088046 | A1 | 4/2009 | Discoe et al. | |
| 2009/0124164 | A1 | 5/2009 | Willett | |
| 2009/0149113 | A1 | 6/2009 | Lund et al. | |
| 2009/0203292 | A1 | 8/2009 | Clark, Jr. et al. | |
| 2011/0031044 | A1* | 2/2011 | Gal | 180/8.2 |

OTHER PUBLICATIONS

"Hacked tyco rebound rc car, now I need ideas on what to do with it" *Lets Make Robots*, http://letsmakerobots.com/node/11403 (Date Accessed, Nov. 14, 2010).

"RC Flying Saucer" *Gadget Venue*, http://www.gadgetvenue.com/rc-flying-saucer-12020024/ (Date Accessed, Nov. 14, 2010).

"Gyro Stabilization for RC Helicopters" *RC Helicopter* http://www.rchelicopter.com/category/rc-helicopter-stabilization-systems/ (Date Accessed, Nov. 14, 2010).

"RC Car / Boat Radio Aluminium Steering Sponge Wheel & Adapters 8 Spoke" *R2Hobbies*, http://www.r2hobbies.com/eng/proddetail.php?prod=rcvp3345012_code (Date Accessed, Nov. 14, 2010).

"Easy Lithium-Ion Upgrade for RC Cars" *Instructables*, http://www.instructables.com/id/Easy-Lithium-Ion-upgrade-for-RC-cars/ (Date Accessed, Nov. 14, 2010).

"RC toy car with 3-channel 2.4Ghz Transmitter" *Shenzhen Longsun Toys Co., Ltd.*, http://toylongsun.en.alibaba.com/product/334104432210171869/rc_toy_car_with_3_channel_2_4Ghz_transmitter.html (Date Accessed, Nov. 14, 2010).

* cited by examiner

TOY VEHICLE

FIELD OF THE DISCLOSURE

The present disclosure relates generally to toy vehicles and, more particularly, to remote control toy vehicles.

A variety of toy vehicles such as toy car are known which may be upset or overturned during normal operation. This can be a problem for operation by a user.

Like a real car, the remote control stunt and racing toy cars are usually designed to achieve a high or top speed with good controllability. However, if the car is small but it is running too fast, i.e. a speed faster than about 4 m/s and the car scale is 1:24, the car can become be out of control easily. The car may crash obstacles more frequent. Sometimes it may be up-side-down and result in four wheels stay on air. The car is no longer controllable by users. In such a case, the user needs to go to the car, pick up and put the car on the floor to play again. This is not convenient for users.

A toy vehicle design having a system to regulate operation irrespective of the orientation would be desirable and provide enhanced entertainment value.

SUMMARY

The present disclosure provides a toy so as to provide amusement to the user.

According to one aspect of the disclosure, a toy vehicle is provided wherein there is a vehicle body having a front portion and a rear portion. A pair of rear wheels is coupled with the rear portion and located on the vehicle so as to at least partially support the rear portion. A first electric motor is drivingly coupled with the at least one rear wheel. There is a pair of front wheels coupled with the front portion and located on the vehicle so as to at least partially support the front portion. An electrically operated steering actuator is mounted on the front portion and is drivingly coupled to the at least one front wheel to rotate the front wheels to steer the toy vehicle.

When the vehicle is inverted, the sensor detects the orientation change and signals a microprocessor inside the vehicle, the microprocessor responds to the signal and changes the left/right motor control signal to the steering motor and the forward/backward motor control signal on the driving motor. This retains the vehicle travelling in the same direction without intervening action by the user.

The disclosure is further described with reference to the accompanying drawings.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which.

DETAILED DESCRIPTION

Figure 1:
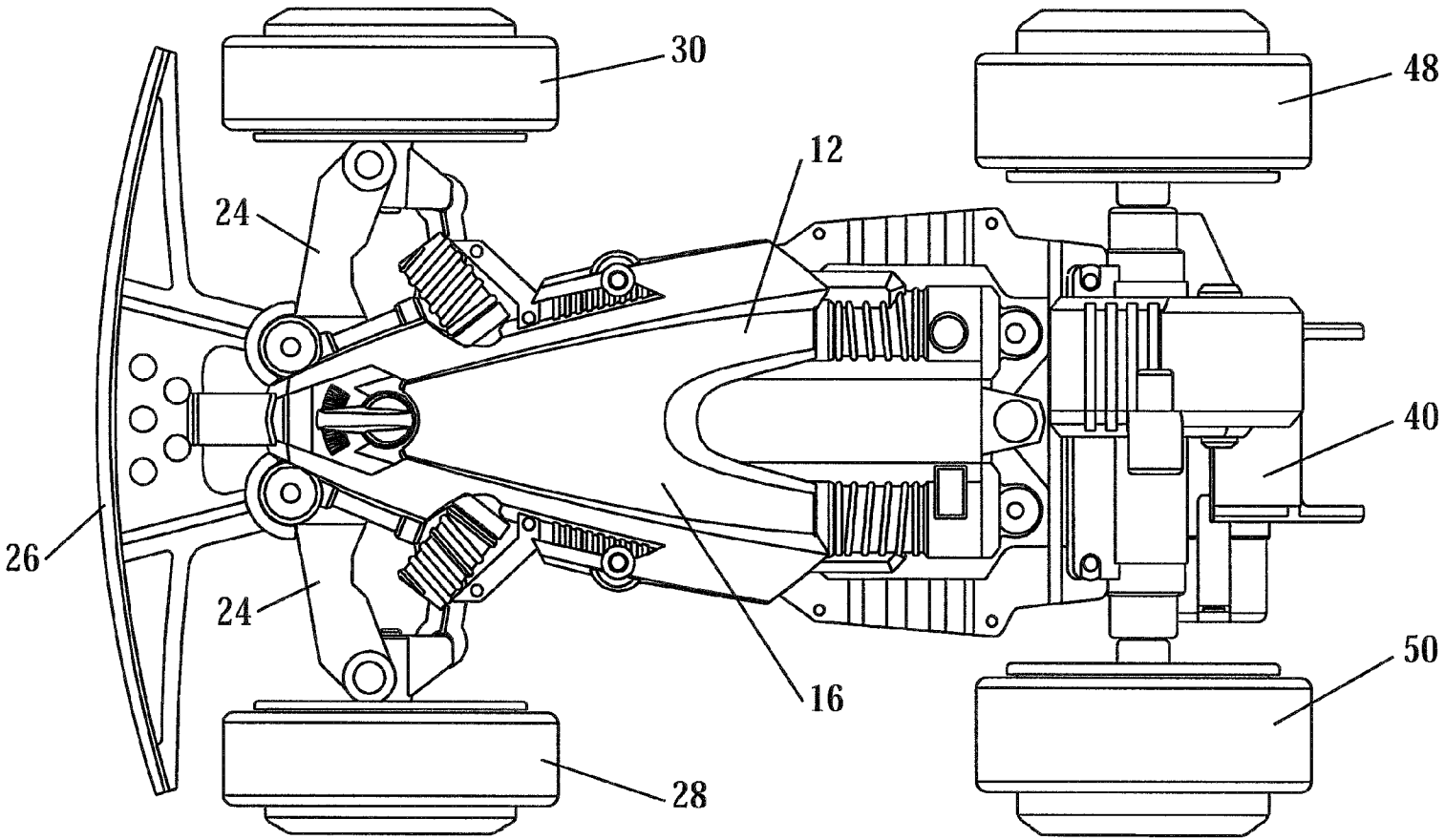
FIG. 1 is a top view of a toy vehicle in an inverted position, namely with the second car housing on top.
Figure 2:
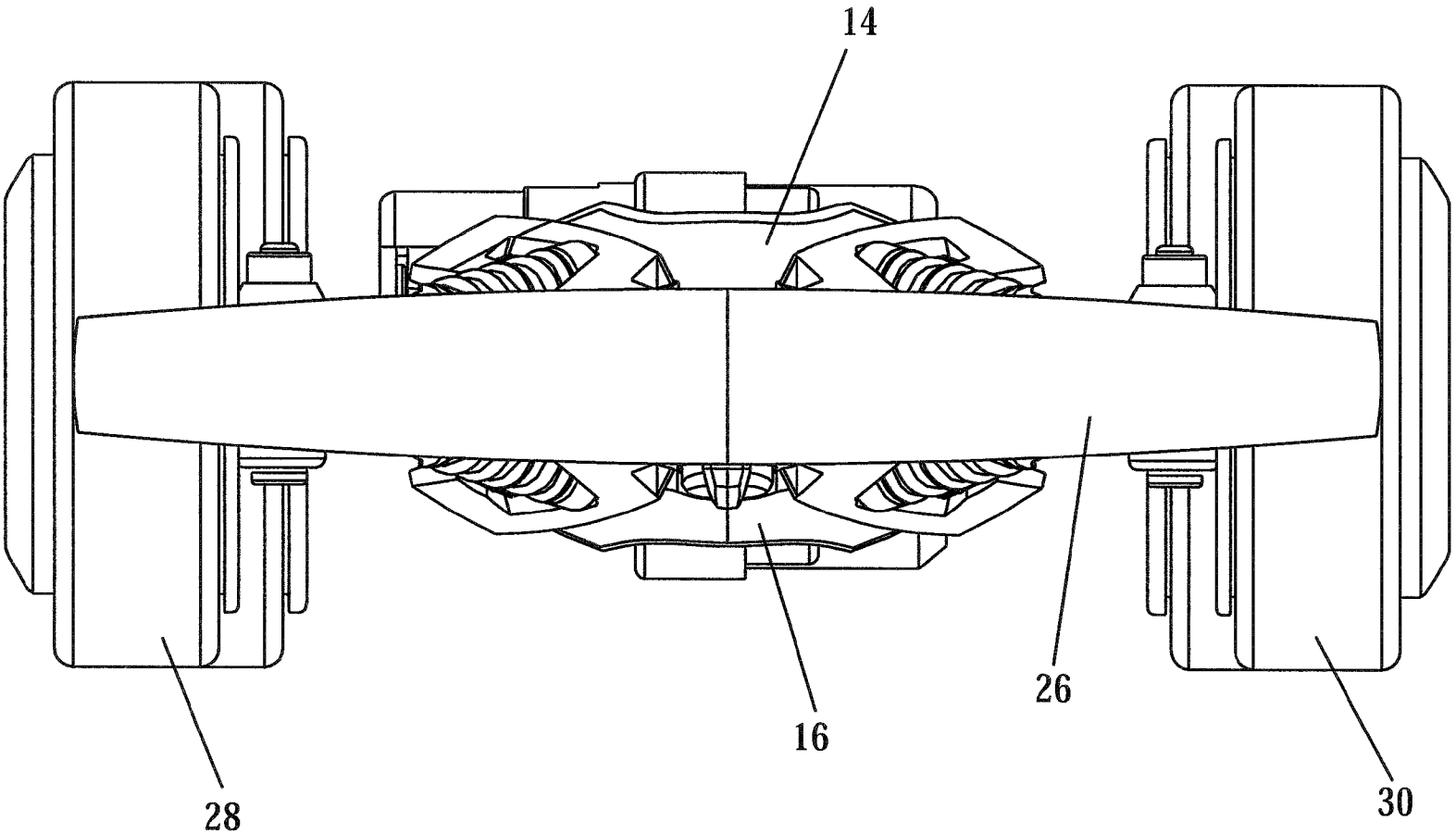
FIG. 2 is a front view of the vehicle in a first, namely non inverted, position.
Figure 3:
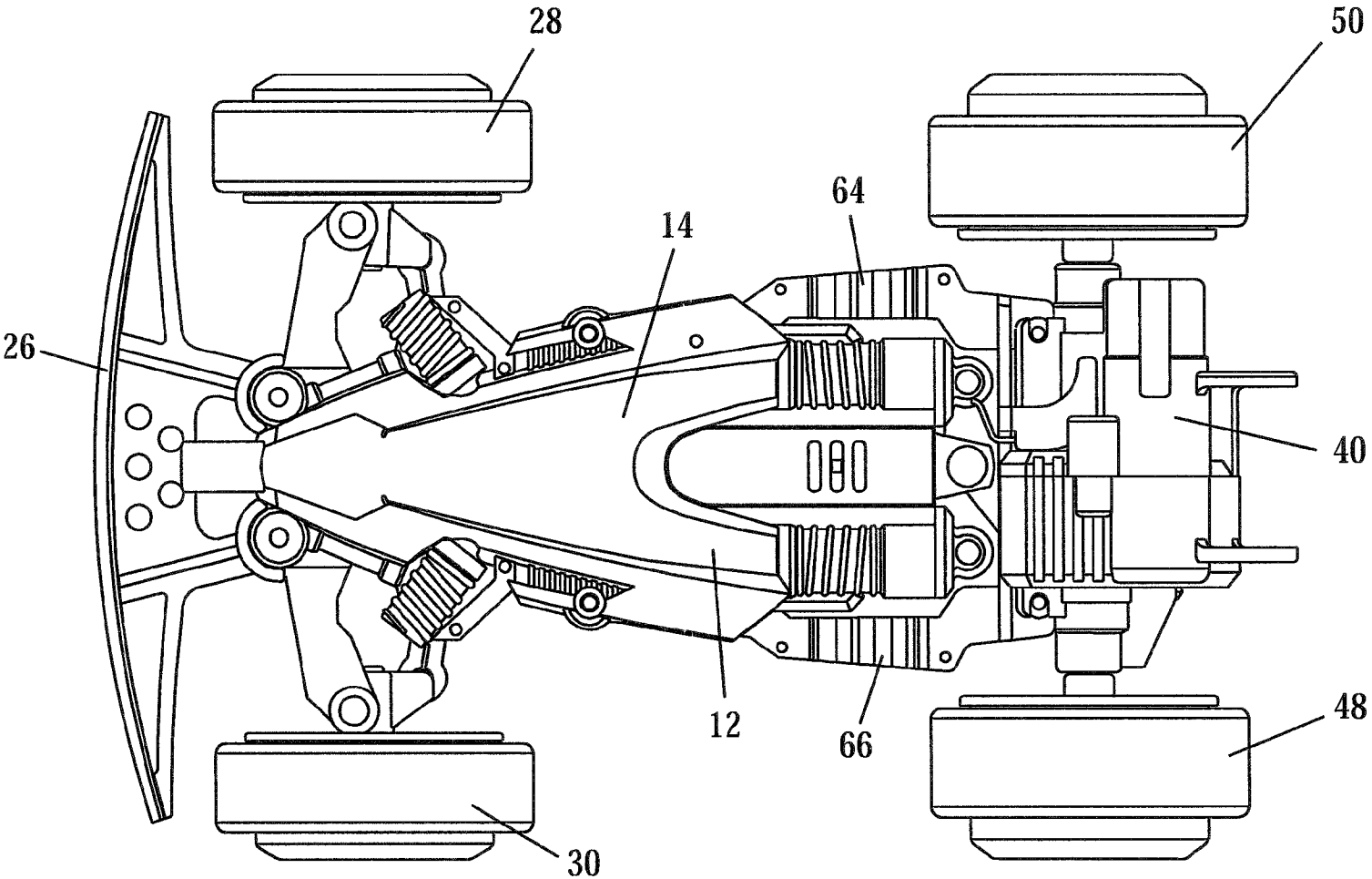
FIG. 3 is a top view of the first position with the first car housing on top.
Figure 4:
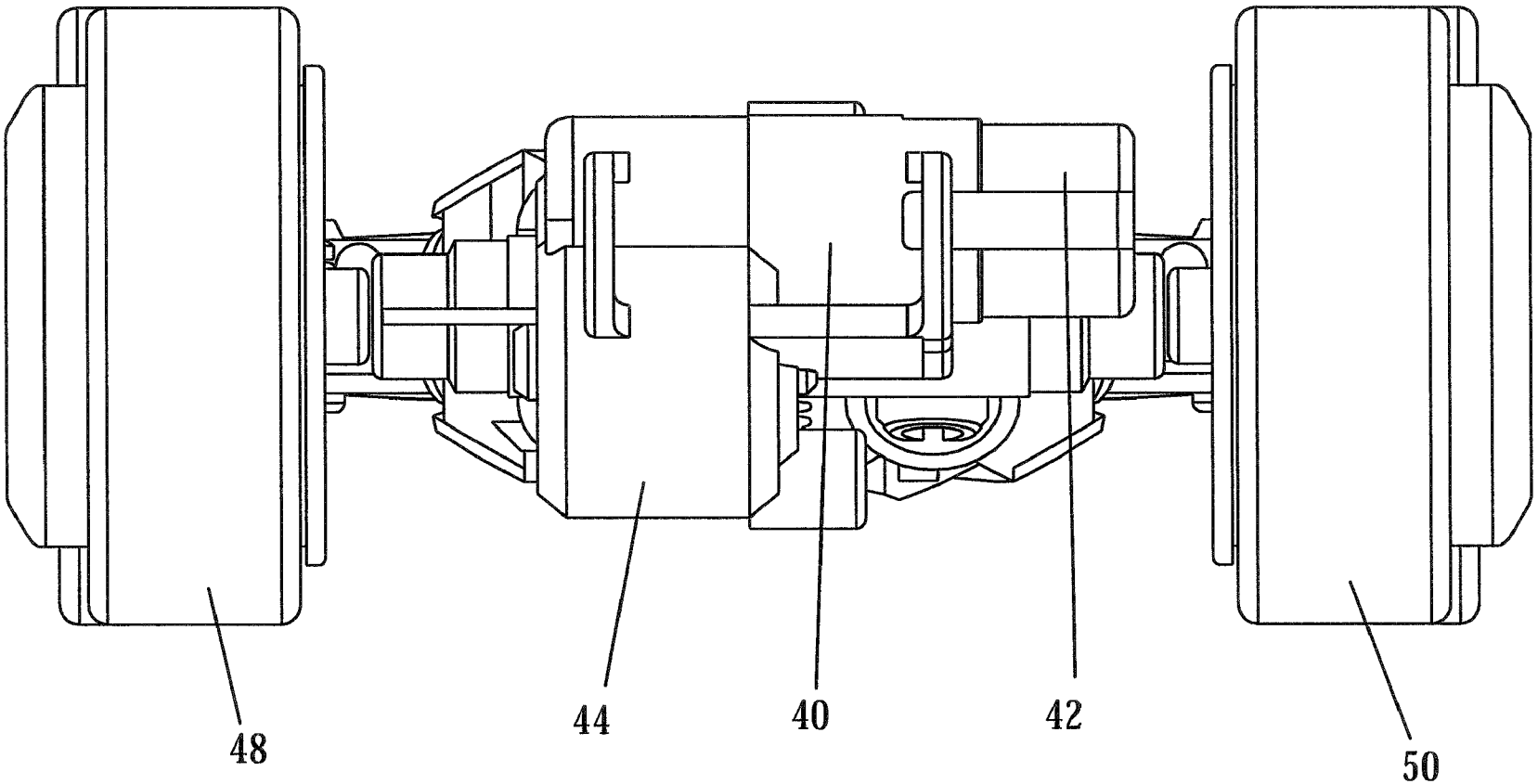
FIG. 4 is a rear view of the first position.
Figure 5:
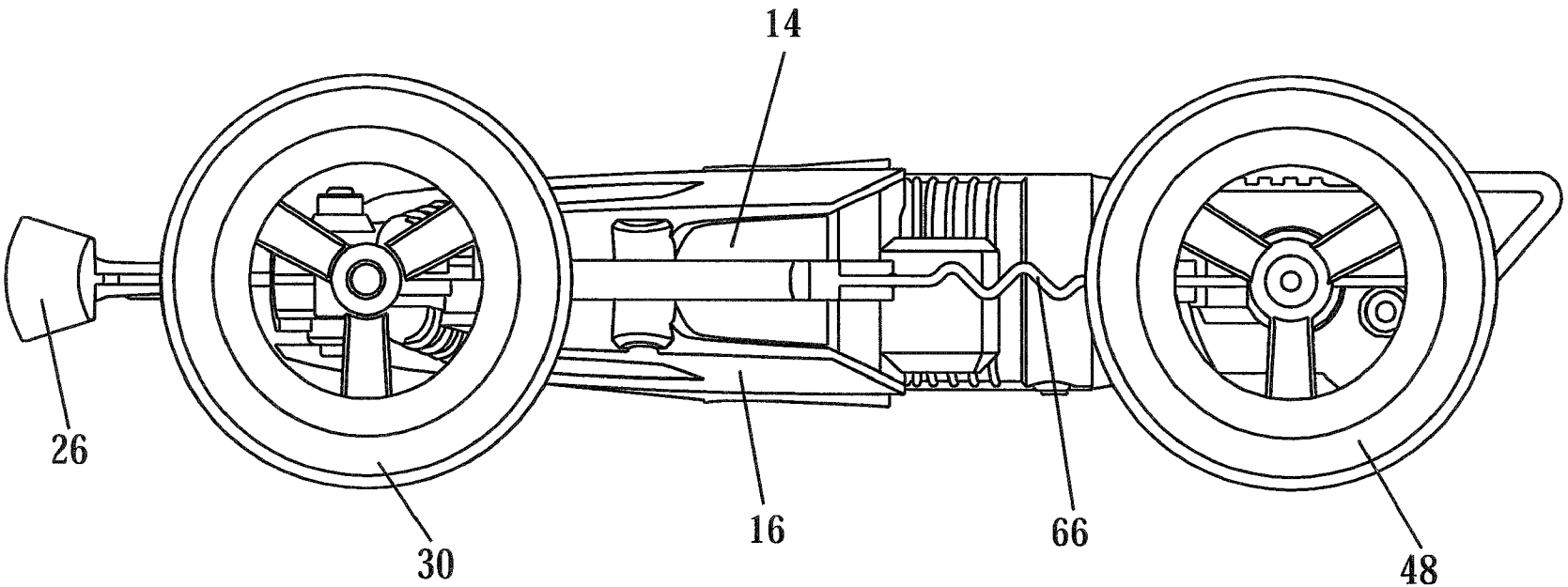
FIG. 5 is a side view of the first position.
Figure 6:
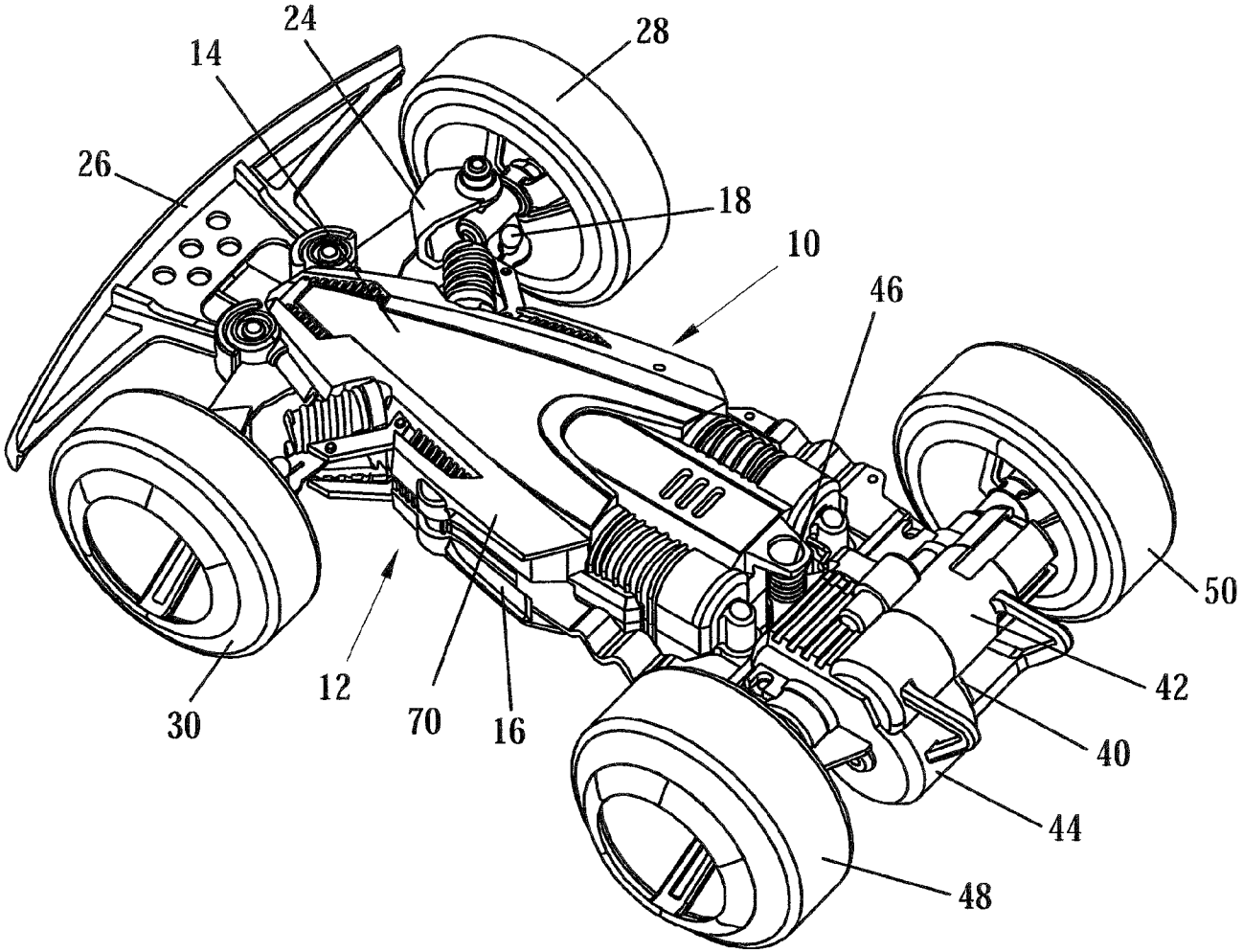
FIG. 6 is a perspective view of the first position.
Figure 7:
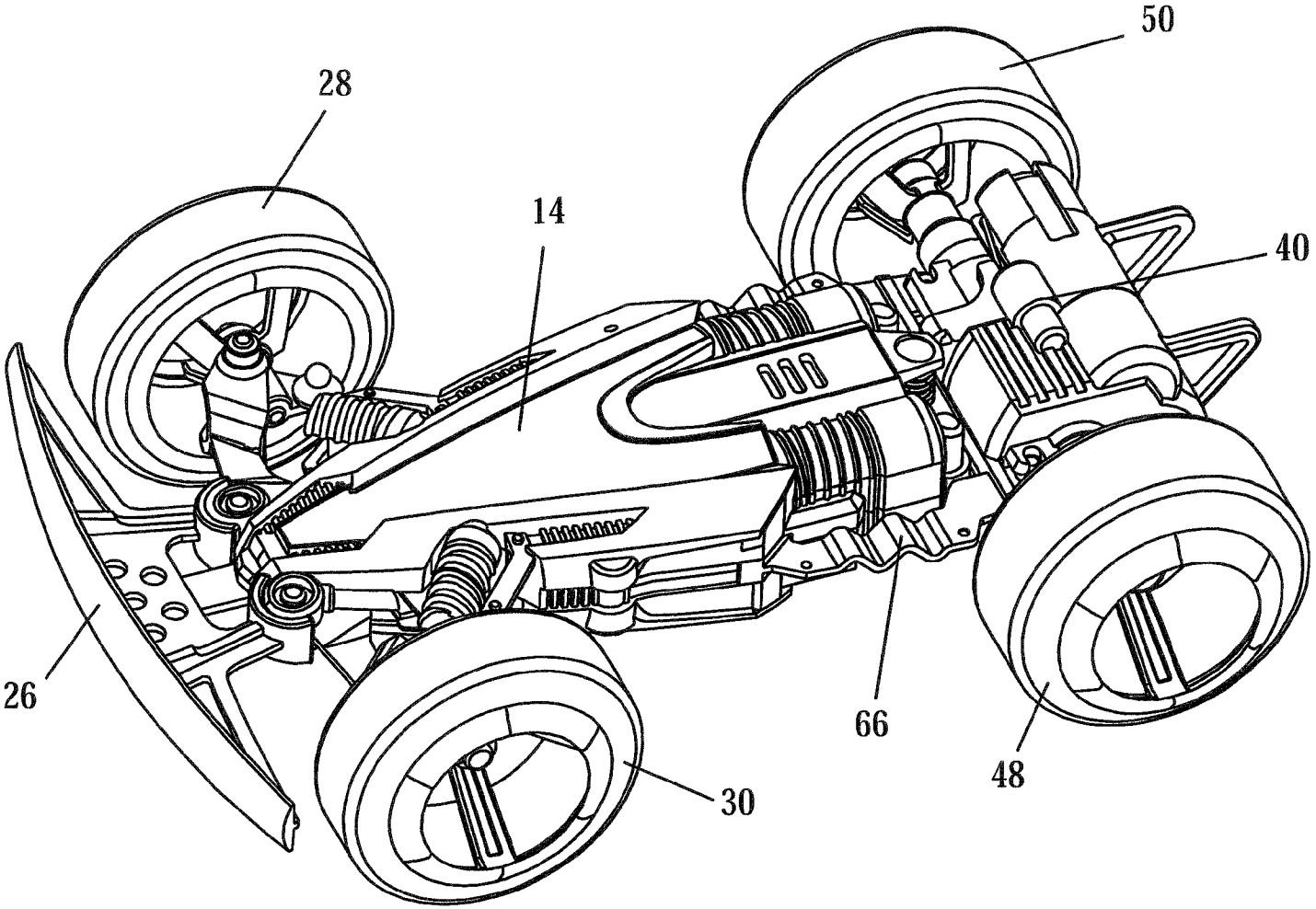
FIG. 7 is a perspective view of the first position.
Figure 8:
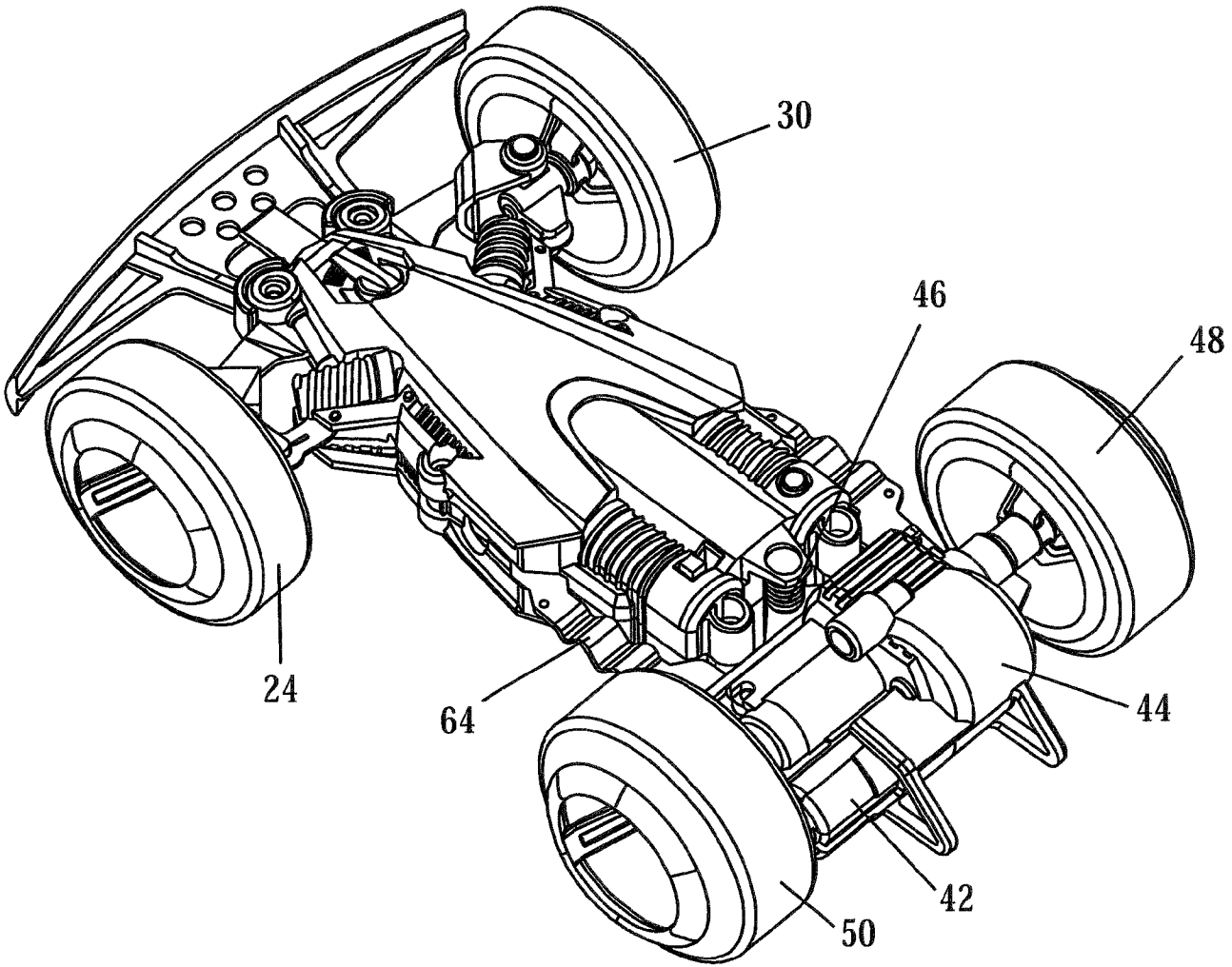
FIG. 8 is a perspective view of the inverted position.
Figure 9:
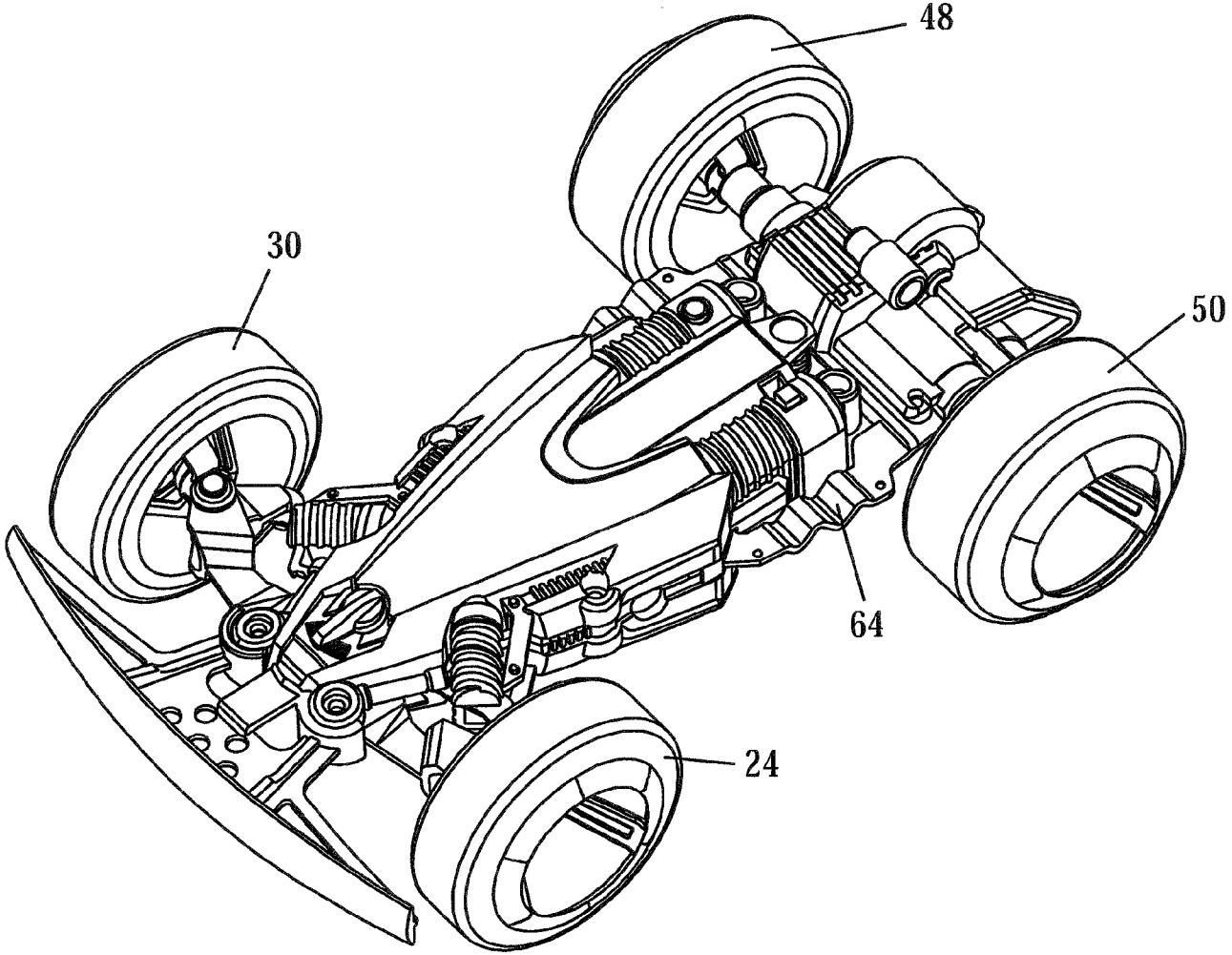
FIG. 9 is a perspective view of the inverted position.
Figure 10:
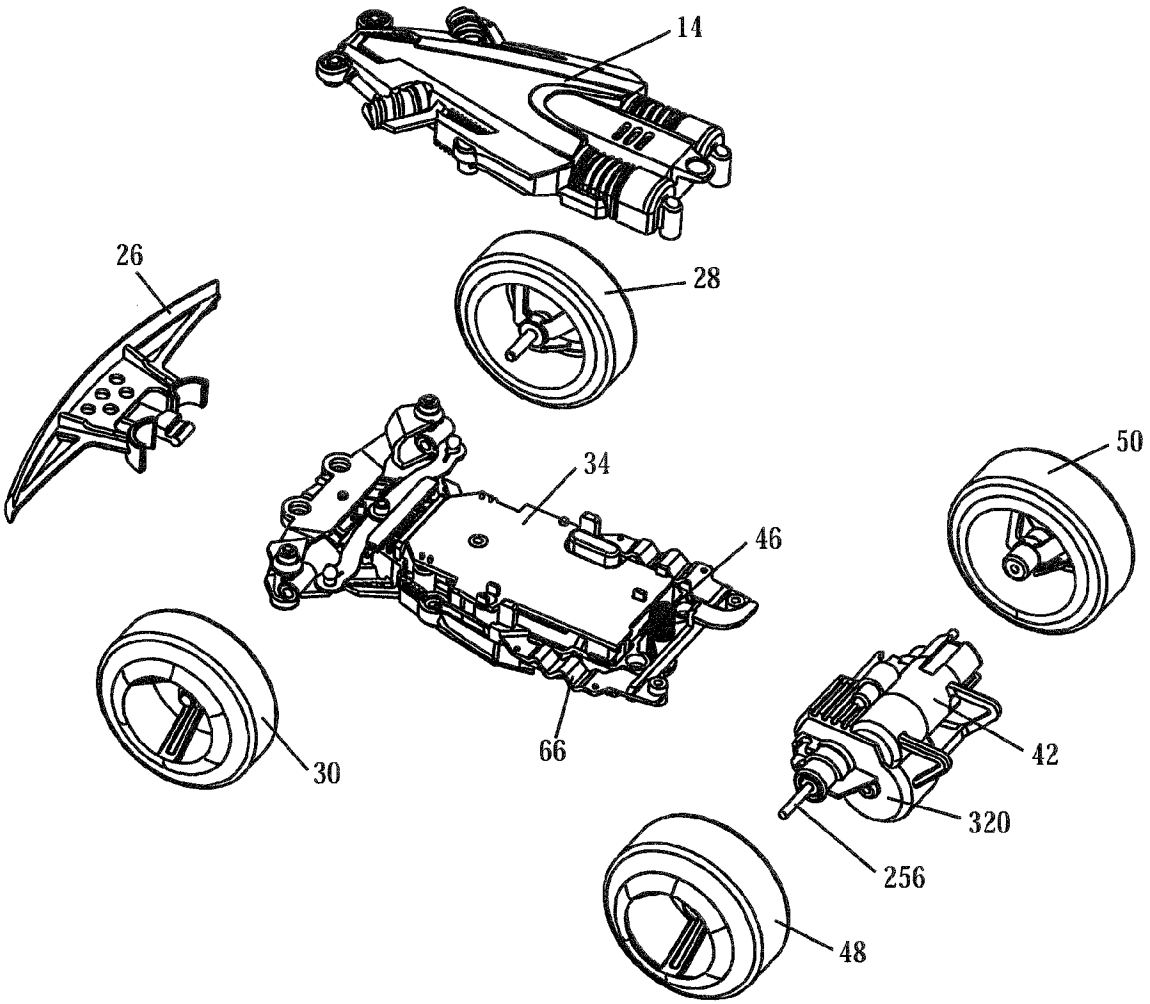
FIG. 10 illustrates the toy showing the front bumper, 4 wheels, front and rear body as well as first car housing.
Figure 11:
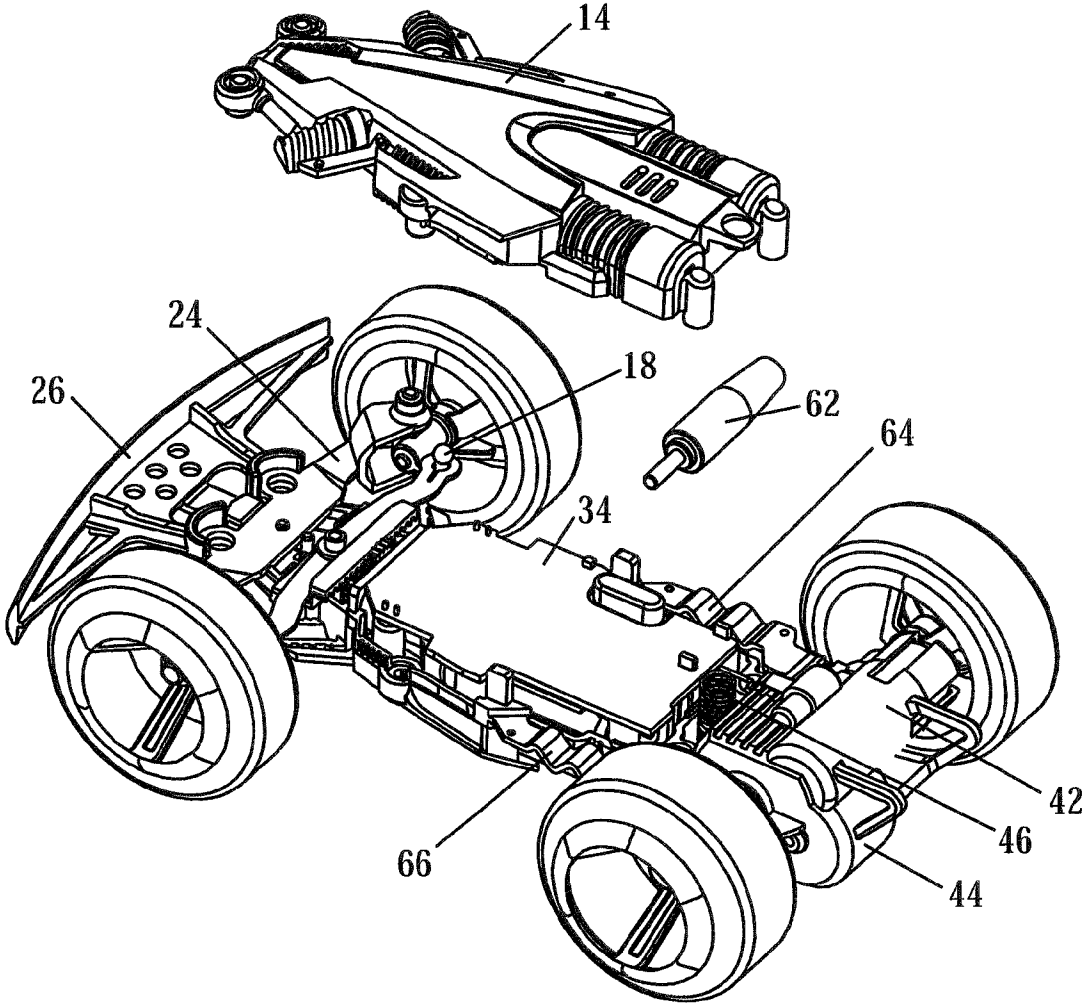
FIG. 11 illustrates the perspective view of the first position of the vehicle showing the charging plug and first car housing.
Figure 12:
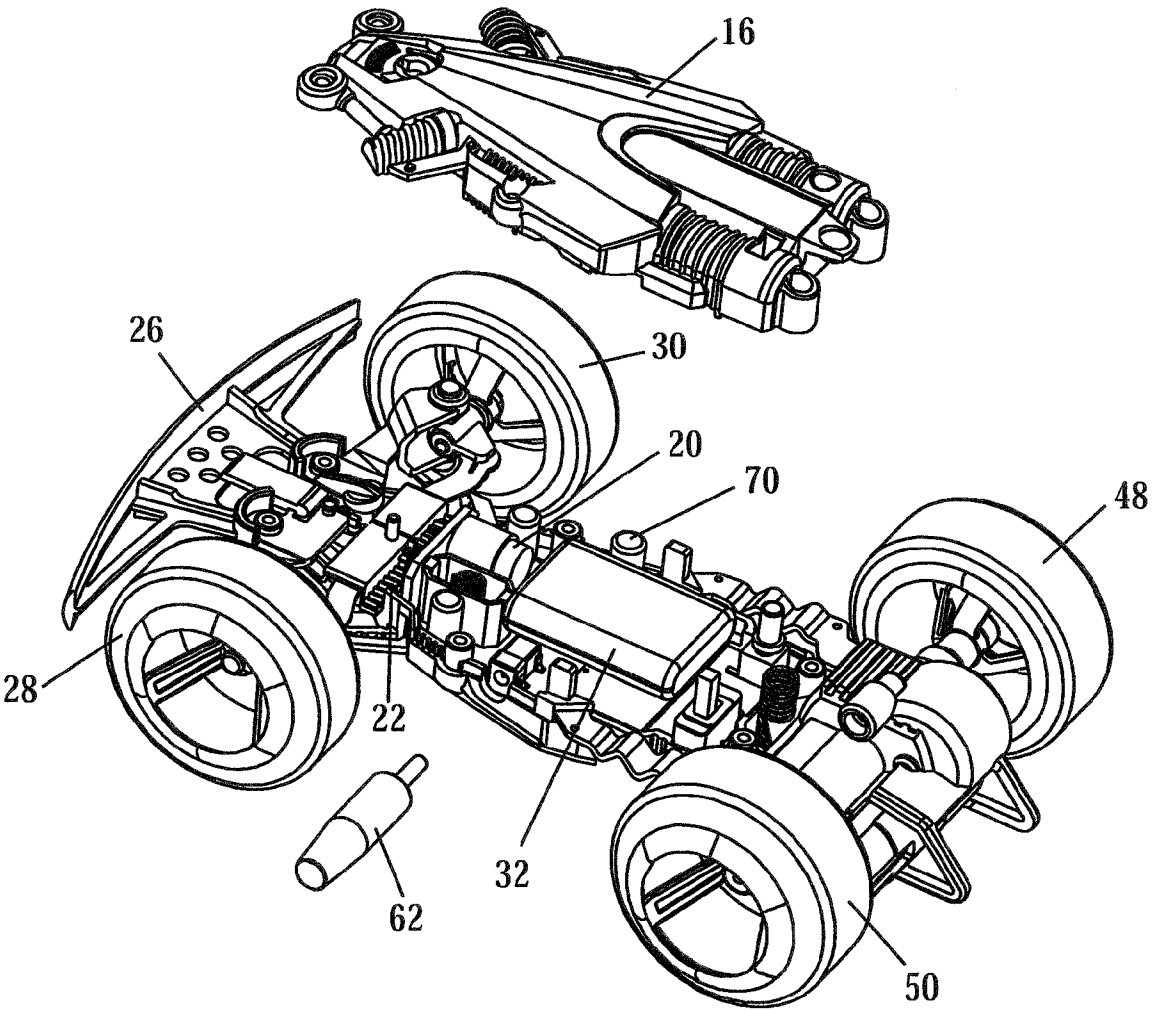
FIG. 12 illustrates the perspective view of inverted position, showing the charging plug and second car housing.
Figure 13:
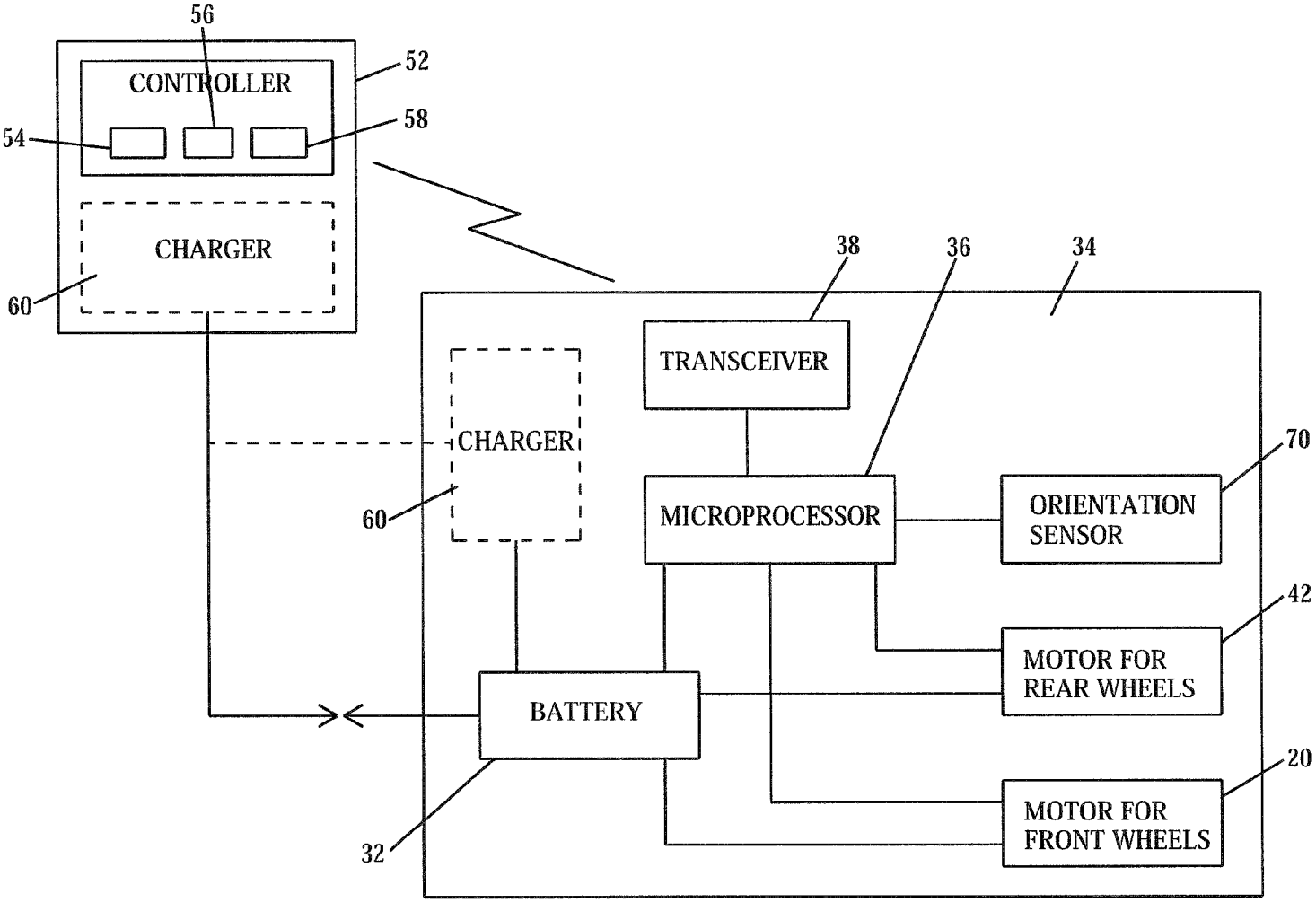
FIG. 13 shows representations of the remote controller, and electronic circuit in the vehicle with different components illustrated in block form.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the vehicle and designated parts thereof. The word "a" is defined to mean "at least one." The terminology includes the words above specifically mentioned, derivatives thereof and words of similar import. In the drawings, like numerals are used to indicate like elements throughout.

The toy car comprises of two separate car bodies. These two bodies are installed on the opposite side of a chassis. The wheel diameter is greater than the maximum height of car bodies. Therefore, when the car is inverted after crashing, flipping, jumping or playing stunt actions, the four wheels can still touch the ground surface. The car can be freely moved and controlled by users. However, once the car is inverted, the control method on transmitter is changed too.

In prior systems, as the direction of wheel rotation does not change after car inversion, the forward and backward movement will be reversed. i.e. press the throttle trigger will drive the car backward and push the throttle trigger forward will drive the car forward. This is the reverse case of normal convention. Similarly, this situation also applies in left/right steering control. Thus, users will be very confused to control the car after inversion.

This disclosure relates to a twin-body high speed remote control toy car, and system to avoid this confusion by a user, so that irrespective of the orientation of the car the user can control the car direction and speed with a minimum of difficulty.

According to the disclosure a toy vehicle, such as a toy car comprises a vehicle body with a front portion and a rear portion and a longitudinal axis extending through the front and rear portions. There is at least one rear wheel coupled with the rear portion and located on the vehicle so as to at least partially support the rear portion.

An electric steering motor is drivingly coupled with at least one wheel. There is at least one front wheel coupled with the front portion and located on the vehicle so as to at least partially support the front portion.

An electrically operated steering actuator is mounted for drivingly coupling at least one wheel to rotate at least one wheel to steer the toy vehicle. A driving motor rotates at least one wheel.

An orientation sensor determines whether the vehicle body is in a first upright position or a second inverse upside down position about the longitudinal axis.

A toy vehicle comprising a movable vehicle and a remote control device having controls for a user to regulate the movement of the vehicle. The orientation sensor determines whether the vehicle body is in a first upright position or a second inverse upside down position about the longitudinal axis. The orientation sensor acts through a microprocessor to switch the direction of rotation of the driven wheels independently of a user changing the controls on the remote control device.

There is an elastic linkage coupling the front and rear portions together, and wherein the at least one rear wheel is the driven wheel.

The car preferably includes a pair of front wheels spaced apart to either side of the vehicle body, and a preferably a pair of rear wheels spaced apart to either side of the vehicle body. There is a pair of spaced elastic linkages arranged to either side of the longitudinal axis which is centrally located between the front and rear portions of the vehicle, and a pair of driving motors for driving the rear wheels.

Further the body can include first and second body housings, the second body housing being the chassis for the first body housing, the first body housing being the chassis for the second body housing. The extremities of the first and second housings have a height between the extremities, and the wheels have diameter greater than the height.

There is a remote control device for communicating with a transceiver located with the vehicle. The transceiver is connected with the orientation sensor, and can selectively signal the orientation of the vehicle to the remote control device.

The remote control device includes one or more control levers also for regulating the rotation of the driven wheel. There can be a program for switching the direction of rotation of the driven wheel(s).

As such the vehicle can be controlled on the one hand by the microprocessor to automatically switch the rotation and steering instructions to the wheels when the car flips is inverted. Additionally the controller can regulate the direction and steering as desired. Thus when the vehicle is orientated in a first direction the wheels rotate and are steered in a first direction, and when the vehicle is in the inverse direction the wheels rotate and are steered in a second direction.

When the remote control receives a signal from the transceiver that the orientation has been inverted, the wheels are rotating in the opposite direction, thereby the remote control device can retain control of the vehicle without switching the orientation of a controller on the remote control device.

When the vehicle is inverted, the sensor detects the orientation change and signals a microprocessor inside the vehicle, the microprocessor responds to the signal and changes the left/right motor control signal to the steering motor and the forward/backward motor control signal on the driving motor.

The wheels are formed of low density material, such as a foam material.

The toy is a combination with a remote control device configured to selectively control movement of the toy vehicle and activation of the rotational drive mechanism.

The remote control device comprises a handheld remote controller having a multi-part housing, and wherein at least two of the housing parts are pivotable with respect to each other in order to control an operation of the toy vehicle.

The twin-body toy car is based on the following design so as to achieve user-friendly control, good controllability and high speed.

In order to obtain high speed, the car should be light, preferably no more than about 50 g. There is a relatively powerful motor to drive at least one of the rear wheels, the wheels are made of sponge, the car body is made of light plastic material such as polypropylene or more high energy density LiPO batteries are chosen. There are miniature coreless motors used for driving the front and rear wheels as needed.

As arranged, the second car housing is at least part of the chassis of the first car housing in first position. Similarly, the first car housing is at least part of the chassis of the second car housing in the inverted position.

The control system is preferably a 2.4 GHz frequency which is chosen because of the compact electronics and also built-in antenna on the PCB.

There is a symmetric suspension system on the chassis to withstand the shock or force exerting on either car housings when the vehicle crashes, flips and/or jumps.

There can be one or more sensors to detect orientation. The car is equipped with a vertical orientation sensor. Once the car is inverted, the sensor detects this change and sends a signal to a microprocessor in the control electronics inside the car. The microprocessor responds to this signal change and exchanges the left/right motor control signal on steering motor and forward/backward motor control signal on rear driving motor. As such the user does not exactly need to know which car body is on top. The user can simply keep the trigger and/or steering wheel position in order to maintain the same movement as before.

The toy car 10 comprises

1. A front body 12 which includes
(1) First car housing 14
(2) Second car housing 16
(3) A steering mechanism 18 associated with a small dc motor 20, potentiometer and gearbox 22 for precise servo control.
(4) Front suspension system 24 for shock absorbing.
(5) A front bumper 26 for shock absorbing.
(6) 2 sponge wheels 28 and 30 which in the alternative may be other low density materials such as EPP, foam or EVA etc.
(7) Battery power source 32 such as LiPO, LiFePO4 or Li-ion.
(8) PCBA 34 for electronic microprocessor system control 36 and a radio transceiver 38 in 2.4 GHz for 2-way communication.
(9) A vertical orientation sensor 70 for inversion detection.

A rear body 40 includes
(1) A driving mechanism associated with one or two powerful dc coreless motor(s) 42 and gearbox(es) 44.
(2) A rear suspension system 46 for shock absorbing
(3) 2 sponge wheels 48 and 50 which in the alternative may be other low density materials such as EPP, foam or EVA etc.

There is a radio controller 52 which is remotely located relative to the car 10 and is used by the user to control speed and direction with different toggle controls 54, 56 and 58 on the face of the controller. There can be a charger unit 60 associated with the controller 52, and the charger is connectable through a cable 62 for recharging the battery 32. In an alternative way, the charger unit 60 can be located inside the car 10, the primary battery is connected to the charger unit 60 through a cable 62.

There are two mechanical elastic linkages 64 and 66 for connecting front and rear body together. These allow a twist movement along the longitudinal direction of chassis so that the car can run in rugged surface.

The front chassis comprises a first top housing and a first bottom housing according to the respective vertical orientation of the care.

The front body can have different forms and can include a hood and fenders mounted to the first top housing. The steering assembly is mounted with the front body, and the front supports a front bumper and at least one and preferably two front wheel assemblies. The front body can further include a first battery, and if desired a second battery.

The front wheel assemblies each include a wheel hub and a tire. The hub is attached to a support arm. The support arms can include a top support pin and a bottom support pin. The support arms further include a steering pivot pin.

The steering assembly is coupled to the wheel assemblies to provide powered steering control. The steering assembly is preferably a conventional design that includes a motor, a slip clutch and a steering gear box, all of which can be contained within motor and gear box housing. A steering actuating lever can extend from the motor and gear box housing, and moves from left to right. The steering actuating lever can fits within a receptacle in a tie rod. The tie rod is provided with holes at each opposing end. The steering pivot pins fit within the holes. As the tie rod moves left and right under the action of the steering actuating lever the front wheel assemblies are caused to turn as support arms are pivoted by steering pivot pins. The position of the tie rod can be adjustable by a steering trim mechanism. One of ordinary skill will appreciate that any know steering assembly can be used with the present disclosure to provide steering control of the toy vehicle 10.

The rear chassis can include a second top housing and a second bottom housing.

The housings can be ornamented cover assemblies.

The rear chassis mounts a drive assembly, one or more rear wheel assemblies mounted to an axle, and mounted for rotation relative to the housing. The housing can include a drive shaft aft support member, a drive shaft forward support member, a spring support member.

A circuit board containing the device electronics is supported by a mounting with the front body. The circuit board is electrically connected with the front and rear motors. An on/off switch is accessible from the underside of the bottom housing.

The antenna is preferably coupled within or to circuit board and is capable of receiving and/or transmitting signals between a remote controller and the circuit board to control operation of the toy vehicle 10.

The drive assembly includes one or two drive motors. The drive motors can be reversible electric motors of the type generally used in toy vehicles. The motors are operably coupled to the axle through a drive gear train. The drive gear train 320 includes a pinion affixed to an output shaft of the drive motors. The pinion engages a combined reduction gear with other gears fixedly attached to the axle 256. The motors can thus drive the rear wheel assemblies through the drive gear train in either a forward or reverse direction. Other drive train arrangements could be used such as belts or other forms of power transmission. The arrangements disclosed herein are not meant to be limiting.

In operation, a user drives the toy vehicle 10 so that irrespective of the orientation the vehicle can continue driving in the selected forward or reverse direction. There is no need for the user to operate the toggle in an opposite direction if the vehicle happens to flip over and is oppositely orientated. The microprocessor on board is signaled by the orientation sensor and it acts to change the direction of rotation of the wheels when the vehicle is orientated oppositely to the normal chosen orientation. In other words the vehicle keeps travelling in the same direction of movement without corrective action of the user. Similarly the left/right steering controls are switched around independent of the user.

The vehicle 10 can be constructed of, for example, plastic or any other suitable material such as metal or composite materials. From this disclosure, it would be obvious to one skilled in the art to vary the dimensions of the toy vehicle 10 shown, for example making components of the toy vehicle smaller or larger relative to the other components. The vehicle 10 may flip while in motion on the ground, or while in the air (e.g. while jumping off of a ramp).

The toy vehicle 10 is preferably controlled via radio (wireless) signals from a remote controller. However, other types of controllers may be used including wired controllers, voice-activated controllers, and the like.

A preferred embodiment of a remote controller for use with the present disclosure preferably comprises a multi-part housing having left hand and right hand toggles. Each of the left hand and right hand toggles are on a top housing. An antenna may be included to receive and/or transmit signals to and/or from the remote controller.

The remote controller also preferably includes circuitry to, for example, process inputs from the switch, the left and right toggles, switches, and to transmit and receive signals to and from the toy vehicle 10.

It will be understood that the remote controller 500 can be formed of a variety materials and may be modified to include additional switches and/or buttons. It will be further understood that a variety of other types of controllers may be used to control the operation of the toy vehicle of the present disclosure.

One of ordinary skill will appreciate that although the embodiments discussed above refer to a single orientation sensor, there could be more than one sensor with the toy vehicle 10 and other modes of operation could be used depending on orientation. For example, the one or more sensors could be actuated upon driving the vehicle in a forward direction, or by activating a switch on a remote controller, or by having the toy vehicle 10 pass over a beacon which is detected by circuitry on the toy vehicle 10. Orientation, other than upright or upside down may be sensed, and the drive and steering motors operated appropriately according to a sensed orientation and programmed operation.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure.

Many of the features of the present disclosure are implemented by suitable algorithms that are executed by one or more the microprocessors with the vehicle and/or remote controller. For example, all voltages and, currents at critical circuit points, and velocity are monitored by the software routines.

Although the present disclosure has been described with respect to particular embodiments thereof, variations are possible. Although the disclosure is described of a four-wheeled embodiment, the present disclosure there could also comprise a vehicle having three wheels, or more than four wheels or a track drive system. There may be a motorcycle format with 2 wheels, or a system with 3 wheels, for instance two in the rear and one in the front. The microprocessor for changing direction and turning of the wheels may be located in the remote controller device rather than the vehicle.

The present disclosure may be embodied in specific forms without departing from the essential spirit or attributes thereof. In particular, although the disclosure is illustrated using a particularly format with particular component values, one skilled in the art will recognize that various values and schematics will fall within the scope of the disclosure. It is desired that the embodiments described herein be considered in all respects illustrative and not restrictive and that reference be made to the appended claims and their equivalents for determining the scope of the disclosure.

The invention claimed is:

1. A toy vehicle comprising a movable vehicle and a remote control device having controls for a user to regulate the movement of the vehicle, the vehicle having a vehicle body with a front portion and a rear portion and a longitudinal axis extending through the front and rear portions; at least one rear wheel coupled with the rear portion and located on the vehicle so as to at least partially support the rear portion; an electric steering motor drivingly coupled with at least one steered wheel, at least one front wheel coupled with the front portion and located on the vehicle so as to at least partially support the front portion; the steering motor drivingly steering the toy vehicle; a driving motor for rotating at least one driven wheel; wherein the body includes first and second body housings, and extremities of the first and second housings having a height between the extremities, and wherein the wheels have a diameter greater than the height, and an orientation sensor for determining whether the vehicle body is in a first upright position or a second inverse upside down position about the longitudinal axis, the orientation sensor acting through a microprocessor to switch the direction of rotation of the driven wheel independently of a user changing the controls on the remote control device; the orientation sensor signals the microprocessor inside the vehicle, the microprocessor responds to the signal and signal to the steering motor and a forward/backward motor control signal on the driving motor, the orientation sensor acting through the microprocessor to switch the direction of rotation of the driven wheel and the left/right motor control signal of the steered wheel, a transceiver located with the vehicle for communicating with the remote control device having controls for the user to regulate the movement of the vehicle, such that when the remote control device communicates with the transceiver, and the orientation has been inverted, and the driven wheel rotation direction is switched and the left/right motor control signal of the steered wheel is changed, the remote control device can retain control of the driven wheel and the steered wheel of the vehicle without switching the orientation of the controls for the user on the remote control device.

2. The toy vehicle according to claim 1, wherein the orientation sensor acting through the microprocessor acts to switch the steering control of the steered wheel according to the orientation of the vehicle independently of a user changing the controls on the remote control device, and thereby retain the vehicle travelling in the same steered direction without intervening action by the user.

3. The toy vehicle according to claim 1, including an elastic linkage coupling the front and rear portions together, and wherein the at least one rear wheel is the driven wheel.

4. The toy vehicle according to claim 2, including a pair of front wheels spaced apart to either side of the vehicle body, a pair of rear wheels spaced apart to either side of the vehicle body, a pair of spaced elastic linkages arranged to either side of the longitudinal axis which is centrally located between the front and rear portions of the vehicle, and the driving motor drives the rear wheels.

5. The toy vehicle according to claim 1, wherein the second body housing is a chassis for the first body housing, the first body housing is a chassis for the second body housing.

6. The toy vehicle according to claim 2 wherein the controls of the remote control device include a controller for regulating the rotation of the driven wheel, and when the vehicle is orientated in a first direction the wheels rotate in a first direction, the orientation sensor acting through the microprocessor to switch the direction of rotation of the driven wheel when the vehicle orientation is inverted, and thereby retain the vehicle travelling in the same driven direction without intervening action by the user.

7. The toy vehicle according to claim 6, and when the remote control communicates with the transceiver, and the orientation has been inverted, and the driven wheel rotation direction is switched the remote control device can retain control of the vehicle without switching the orientation of the controller on the remote control device, and wherein the controller is a control lever.

8. A toy vehicle comprising a movable vehicle and a remote control device having controls for a user to regulate the movement of the vehicle, the vehicle having a vehicle body with a front portion and a rear portion and a longitudinal axis extending through the front and rear portions; at least one rear wheel coupled with the rear portion and located on the vehicle so as to at least partially support the rear portion; an electric steering motor drivingly coupled with at least one steered wheel, at least one front wheel coupled with the front portion and located on the vehicle so as to at least partially support the front portion; the steering motor drivingly steering the toy vehicle; a driving motor for rotating at least one driven wheel; wherein the body includes first and second body housings, and extremities of the first and second housings having a height between the extremities, and wherein the wheels have a diameter greater than the height, and an orientation sensor for determining whether the vehicle body is in a first upright position or a second inverse upside down position about the longitudinal axis, the orientation sensor acting through a microprocessor to switch the direction of rotation of the driven wheel independently of a user changing the controls on the remote control device the orientation sensor signals the microprocessor inside the vehicle, the microprocessor responds to the signal and changes a left/right motor control signal to the steering motor and a forward/backward motor control signal on the driving motor, the orientation sensor acting through the microprocessor to switch the direction of rotation of the driven wheel and the left/right motor control signal of the steered wheel, a transceiver located with the vehicle for communicating with the remote control device having controls for the user to regulate the movement of the vehicle, such that when the remote control device communicates with the transceiver, and the orientation has been inverted, and the driven wheel rotation direction is switched and the left/right motor control signal of the steered wheel is changed, the remote control device can retain control of the driven wheel and the steered wheel of the vehicle without switching the orientation of the controls for the user on the remote control device, and wherein the wheels are formed of low density material.

9. A toy vehicle comprising a vehicle body having a front portion and a rear portion and a longitudinal axis extending through the front and rear portions; a pair of rear wheels coupled with the rear portion and located on the vehicle so as to at least partially support the rear portion; a first electric driving motor drivingly coupled with at least one rear wheel; a pair of front wheels coupled with the front portion and located on the vehicle so as to at least partially support the front portion; an electrically operated steering motor mounted on the front portion and drivingly coupled to at least one front wheel to steer the toy vehicle; wherein the body includes first and second body housings, and extremities of the first and second housings having a height between the extremities, and wherein the wheels have a diameter greater than the height, and an orientation sensor for determining whether the vehicle body is in a first upright position or a second inverse upside down position about the longitudinal axis, wherein when the vehicle is inverted, the orientation sensor detects the orientation change and signals a microprocessor inside the vehicle, the microprocessor responds to the signal and changes a left/right motor control signal to the steering motor and a forward/backward motor control signal on the driving motor, the orientation sensor acting through the microprocessor to switch the direction of rotation of the at least one rear wheel and the left/right motor control signal of the at least one front wheel independently of action by a user playing with the vehicle, a transceiver located with the vehicle for communicating with a remote control device having controls for the user to regulate the movement of the vehicle, the orientation sensor action being independent of the user changing the controls on the remote control device, such that when the remote control device communicates with the transceiver, and the orientation has been inverted, and the at least one rear wheel rotation direction is switched and the left/right motor control signal of the at least one front wheel is changed, the remote control device can retain control of the at least one rear wheel and the at least one front wheel of the vehicle without switching the orientation of the controls for the user on the remote control device and wherein the wheels are formed of low density material.

* * * * *